US006071464A

United States Patent [19]

Funaki et al.

[11] Patent Number: 6,071,464

[45] Date of Patent: Jun. 6, 2000

[54] PROCESS FOR MODIFYING SURFACES OF HARD MATERIALS AND CUTTING TOOLS

[75] Inventors: Mitsuhiro Funaki; Mitsuo Kuwabara; Kazuhito Hiraga; Tetsuya Ohishi, all of Sayama, Japan

[73] Assignee: Honda Giken Kogyo Kabushiki Kaisha, Tokyo, Japan

[21] Appl. No.: 09/021,293

[22] Filed: Feb. 10, 1998

[30] Foreign Application Priority Data

Mar. 11, 1997 [JP] Japan ..... 9-056643

[51] Int. Cl.[7] ..... B24B 1/00

[52] U.S. Cl. ..... 264/603; 427/226; 427/376.1; 264/625; 264/626

[58] Field of Search ..... 51/295; 264/625–626; 427/226, 376.1

[56] References Cited

U.S. PATENT DOCUMENTS 3,696,707 10/1972 Schedler et al. .

4,488,882 12/1984 Dausinger et al. ..... 51/295

5,223,195 6/1993 Kuwabara ..... 427/226

5,945,167 8/1999 Kuwabara et al. ..... 427/376.3

*Primary Examiner*—James Derrington

*Attorney, Agent, or Firm*—Merchant & Gould P.C.

[57] ABSTRACT

A process for modifying the surface of a base metal formed from a hard material instead of forming a coating film thereon comprises compacting a powder of a hard material, baking the compacted product, dipping the baked product in an alkoxide containing titanium, and sintering the alkoxide-covered baked product in a nitrogen gas atmosphere. The sintered product has very hard titanium carbide, nitride or carbide-nitride particles deposited on the base metal surface. The particles are partly embedded in the base metal and partly protrude from its surface, and are, therefore, very unlikely to come off, while they withstand a temperature change very well.

1 Claim, 5 Drawing Sheets

[BAKED PRODUCT]

[DIPPING]

[SINTERED PRODUCT]

PROCESS FOR MODIFYING SURFACES OF HARD MATERIALS AND CUTTING TOOLS

BACKGROUND OF THE INVENTION

1. Field of the Invention

This invention relates to a process for modifying the surfaces of hard materials, and to cutting tools.

2. Description of the Related Art

Metal cutting tools are partly formed of hard materials including ultrahard alloys, cermets and ceramics. For improving their wear resistance, the surfaces of the hard material portions are coated with a layer or layers formed by chemical or physical vapor deposition (CVD or PVD) from titanium (Ti), hafnium (Hf) or zirconium (Zr) carbide (e.g. TiC), or nitride (e.g. TiN), or carbide-nitride (e.g. Ti(C,N)), or aluminum (Al) oxide (e.g. $Al_2O_3$).

Research has also been conducted for developing a special base metal with a surface containing a reduced amount of cobalt (Co) as a result of its exposure to a plasma and exhibiting an improved adhesion relative to a coating film, so that the coating film may have a reduced internal stress and may not peel off easily.

Both known technologies are concerned with the formation of a hard coating film on the base metal. The coating film is, however, greatly different from the base metal in physical and chemical properties, particularly coefficient of thermal expansion, and is, therefore, very likely to crack and peel off the base metal during cooling after vapor deposition at a high temperature. Thus, the film is not satisfactory in terms of durability, though it may be of high hardness and wear resistance. Moreover, the cleansing of the base metal, which has to be done prior to its coating, requires a high level of technique and a long period of time, thereby adding a great deal to the cost of manufacture.

SUMMARY OF THE INVENTION

It is an object of this invention to provide a technique for modifying the surface of a base metal formed from a hard material instead of forming a coating film thereon.

According to a first aspect of this invention, there is provided a process for modifying the surface of a hard material which comprises the steps of compacting a powder of a hard material consisting mainly of tungsten carbide (WC), baking the compacted product thereof, dipping the baked product in an alkoxide containing titanium, and sintering the alkoxide-covered baked product in a nitrogen gas atmosphere.

The "alkoxide" is a compound having one or more alkoxyl groups linked to a metal. The alkoxyl group is a group formed by adding one oxygen atom to an alkyl group.

The step of sintering gives a sintered product having very hard titanium carbide, nitride or carbide-nitride particles deposited on the base metal surface. These particles are partly embedded in the base metal and partly protrude from its surface, and are, therefore, very unlikely to come off and also withstand a temperature change very well.

According to a second aspect of this invention, there is provided a cutting tool made of a hard material having titanium carbide, nitride or carbide-nitride particles deposited on its surface.

The tool has a drastically improved durability, since those particles are partly embedded in the base metal and partly protrude from its surface, and are, therefore, very unlikely to come off and also withstand a temperature change very well.

The particles form a layer having an effective thickness of, say, at least 5 microns as will be apparent from a description of examples of experiments. The layer having an effective thickness of at least 5 microns gives the tool a satisfactorily prolonged life.

BRIEF DESCRIPTION OF THE DRAWINGS

Description will now be made in detail of preferred embodiments of this invention with reference to the accompanying drawings, in which.

DETAILED DESCRIPTION OF THE PREFERRED EMBODIMENTS

Figure 1:
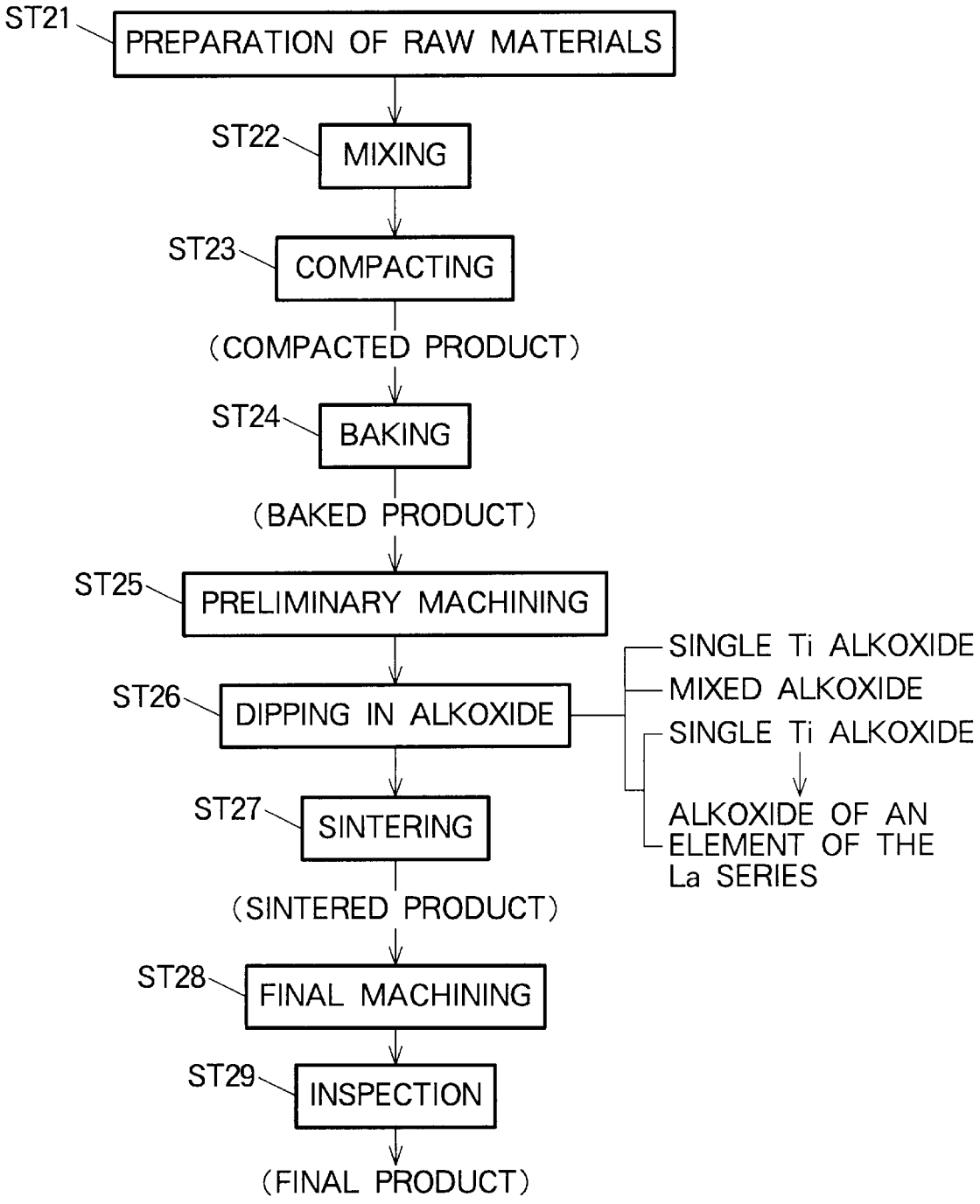
FIG. 1 is a chart showing a surface modifying process embodying this invention.

FIG. 1 is a chart showing a process embodying this invention for modifying the surface of a hard material, in which ST stands for a step, and ( ) shows an intermediate or final product.

ST21: Appropriate amounts of powders of raw materials to be employed for making a hard material, are prepared from, for example, a powder of tungsten carbide (WC), a powder of titanium carbide (TiC), a powder of tantalum carbide (TaC), a powder of niobium carbide (NbC) and a powder of cobalt (Co).

ST22: Those powders are thoroughly mixed in a mixer, or ball mill.

ST23: The mixed powders are compacted in e.g. a press molding machine to form a compacted product having substantially the same shape as a final product.

ST24: The compacted product is baked to make a baked product. Baking means firing the compacted product at an appropriate temperature (e.g. 900° C.) in a vacuum to make it sufficiently strong for retaining its shape.

ST25: The baked product is machined for purposes including the preliminary correction of its shape, if required.

ST26: The baked product is dipped in an alkoxide containing titanium (a single, or mixed alkoxide).

A preferred single titanium alkoxide is tetra-i-propoxytitanium $\{Ti(O—i—C_3H_7)_4\}$ [hereinafter referred to as $Ti(OPr)_41$]. A mixed alkoxide is a mixture of a single titanium alkoxide and an alkoxide containing an element of the La series. The element of the La series is lanthanum (La), tantalum (Ta), samarium (Sm), cerium (Ce), neodymium (Nd), etc. $Ta(OBt)_5$, which will appear below, stands for penta-n-butoxytantalum $\{Ta(O—n—C_4H_9)_5\}$. Preferred mixed alkoxides are a mixture of $Ti(OPr)_4$ and $Ta(OBt)_5$, a mixture of $Ti(OPr)_4$ and $Sm(NO_3)_3$ and a mixture of $Ti(OPr)_4$ and $Ce(NO_3)_3$.

The alkoxide dipping of the baked product may be carried out in one of three ways: (1) by dipping it in a single titanium alkoxide, (2) dipping it in a mixed alkoxide, and (3) by dipping it in a single titanium alkoxide and then in an alkoxide of an element of the La series, as shown at ST26 in FIG. 1. Its dipping may be repeated a plurality of times in any of those three ways, or in a combination thereof to enable an appropriate amount of particles to be deposited to form a layer having an appropriate density and thickness as required on the final product intended.

Carbon is preferably supplied by the free carbon which the powders of raw materials contain, though it may instead be supplied from an external source. An acid, such as the acetate or nitrate of lanthanum, or like element, is preferably added to titanium alkoxide to stabilize it, since it is easily hydrolyzable.

ST27: The alkoxide-dipped product is sintered by holding at a temperature of 1380° C. to 1500° C. for an hour in a nitrogen gas atmosphere having a gauge pressure of 1.0 to 9.8 kg/cm$^2$. Its sintering is carried out by holding the powder at a temperature not causing it to melt completely, so that its particles may be bonded together. Therefore, it is essential to employ a nonoxidizing atmosphere, and in other words, it is necessary to employ an atmosphere formed by an inert gas, such as nitrogen or argon gas, or to maintain a vacuum. Nitrogen gas is employed to promote nitriding in the examples which will be described, but an argon gas, or vacuum atmosphere is employed if carbiding is principally intended. The sintering step allows particles of, for example, titanium carbide-nitride to be deposited on the base metal, as will later be described in detail.

ST28: The sintered product is machined to have its shape finalized.

ST29: It is inspected for dimensions, and other items to give a final product.

Figure 2A:
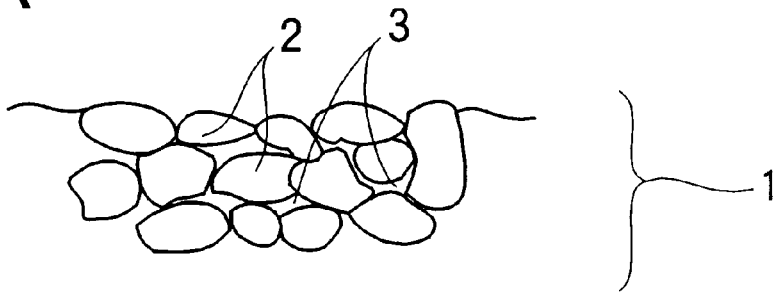
FIGS. 2A, 2B and 2C are a series of illustrations for explaining the formation of titanium carbide-nitride particles according to this invention.
Figure 2B:
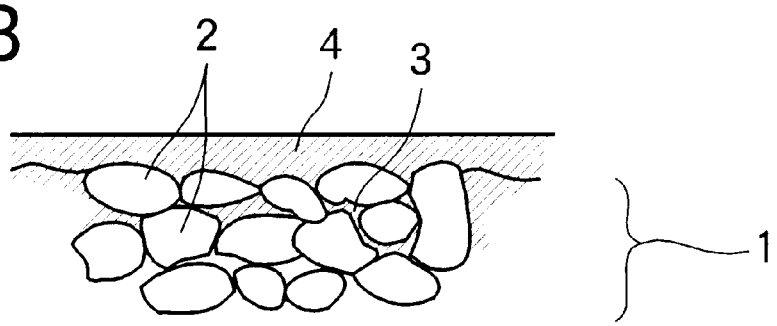
Figure 2C:
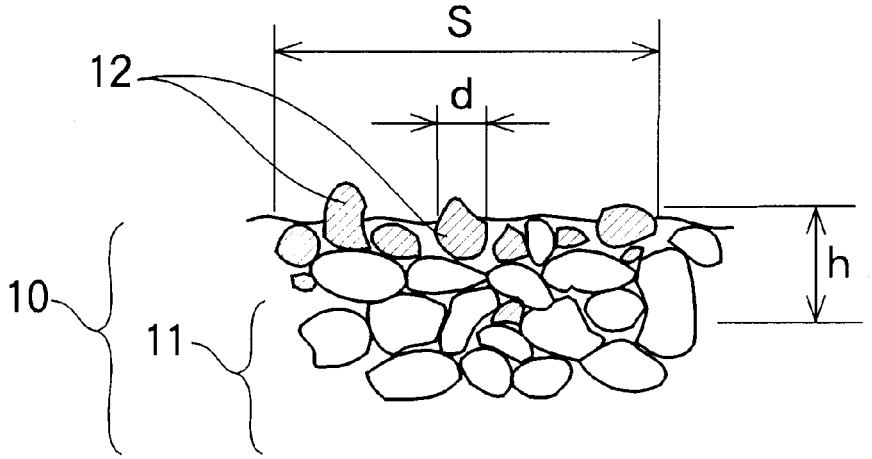

FIGS. 2A to 2C are a series of illustrations for explaining the formation of particles of titanium carbidenitride according to this invention. FIG. 2A is an enlarged fragment of the surface of a baked product 1 and shows particles 2 of powders of WC, TiC, Co, etc. forming the base metal and interstices 3 formed therebetween. FIG. 2B shows an alkoxide 4 adhering to the baked product 1 dipped therein and also penetrating the interstices 3 between its particles 2.

Then, the alkoxide-dipped product is sintered in a nitrogen gas atmosphere, and a reaction takes place in accordance with one of the following formulas depending on the alkoxide employed:

$$\text{Ti alkoxide}+C \rightarrow TiC+CO+CO_2$$

$$\text{Ti alkoxide}+N_2 \rightarrow TiN+CO+CO_2$$

$$\text{Ti alkoxide}+N_2+C \rightarrow Ti(C,N)+CO+CO_2$$

$$\text{Mixed alkoxide}+C \rightarrow (Ti,M)C+CO+CO_2$$

$$\text{Mixed alkoxide}+N_2 \rightarrow (Ti,M)N+CO+CO_2$$

$$\text{Mixed alkoxide}+N_2+C \rightarrow (Ti,M)(C,N)+CO+CO_2$$

(where M is one or more elements selected from among La, Ta, Ce, Nd and Sm.)

These reactions form a deposit of titanium carbide, such as TiC or (Ti,M)C, titanium nitride, such as TiN or (Ti,M)N, or titanium carbide-nitride, such as Ti(C,N) or (Ti,M)(C,N). These titanium carbides, nitrides and carbide-nitrides are referred to simply as titanium carbide-nitrides.

FIG. 2C is an enlarged fragment of the surface of a sintered product 10 and shows titanium carbide-nitride particles 12 deposited on the surface of a base metal 11 and including particles entirely embedded in the base metal 11 and partly embedded and protruding ones. The titanium carbide-nitride particles 12 are of high hardness, and if they are formed on a cutting tool, they do a cutting job and thereby protect the base metal 11. The particles 12 are embedded in the base metal 11 so tightly as not to come off easily.

FIG. 2C shows the diameter of deposited particles at d, the effective thickness of a layer of deposited particles at h, and the unit area at S, which will be referred to again in the description of graphs.

EXAMPLES

Description will now be made of examples of experiments conducted for carrying out this invention.

(1) Preparation of Raw Materials

Powders of raw materials having an average particle diameter of 1.0 micron were prepared in the following proportions:

WC powder—72% by weight

TiC powder—8% by weight

TaC powder—10% by weight

NbC powder—1% by weight

Co powder—9% by weight (2) Mixing

The powders were mixed together in the wet state for 24 hours, and dried.

(3) Compacting

The powder mixture was compacted in a press at a pressure of 1000 kg/cm$^2$ to form throwaway tips (Samples 1 to 11).

(4) Baking

The samples were heated at 900° C. for an hour in a vacuum.

(5) Alkoxide dipping

Samples 1 to 3 were dipped in a single titanium alkoxide and left to stand for 10 minutes, and Samples 4 to 11 in mixed alkoxides. For further details, see Table 1.

TABLE 1

| Sample | Single or mixed alkoxide | Specific compound(s) | Concentration | Dipping time |
|---|---|---|---|---|
| 1 | Single alkoxide | $Ti(OPr)_4$ | 20% | 10 min |
| 2 | Single alkoxide | $Ti(OPr)_4$ | 100% | 10 min |
| 3 | Single alkoxide | $Ti(OPr)_4$ | 100% | 10 min |
| 4 | Mixed alkoxide | $Ti(OPr)_4$ + $Ta(OBt)_5$ | 95:5 | 10 min |
| 5 | Mixed alkoxide | $Ti(OPr)_4$ + $Ta(OBt)_5$ | 99:1 | 10 min |
| 6 | Mixed alkoxide | $Ti(OPr)_4$ + $Sm(NO_3)_3$ | 90:10 | 10 min |
| 7 | Mixed alkoxide | $Ti(OPr)_4$ + $Sm(NO_3)_3$ | 95:5 | 10 min |
| 8 | Mixed alkoxide | $Ti(OPr)_4$ + $Sm(NO_3)_3$ | 99:1 | 10 min |
| 9 | Mixed alkoxide | $Ti(OPr)_4$ + $Ce(NO_3)_3$ | 90:10 | 10 min |
| 10 | Mixed alkoxide | $Ti(OPr)_4$ + $Ce(NO_3)_3$ | 95:5 | 10 min |
| 11 | Mixed alkoxide | $Ti(OPr)_4$ + $Ce(NO_3)_3$ | 99:1 | 10 min |

Referring to Sample 4, the concentration of 95:5 means that the mixed alkoxide consists of 95% by volume of $Ti(OPr)_4$ and 5% by volume of $Ta(OBt)_5$. The same explanation applies to sample 5 to 11.

(6) Sintering

Sintering was continued for an hour at a temperature of 1380° C. to 1500° C. in a nitrogen gas atmosphere having a pressure of 1,5 or 9.8 kg/cm$^2$ (gauge pressure), as shown in Table 2.

TABLE 2

| Sample | Pressure of atmosphere | Sintering temperature | Heating time | Diameter of deposited particles | Thickness of a layer of particles |
|---|---|---|---|---|---|
| 1 | 9.8 kg/cm | 1380° C. | 1 h | 0.2 μm | 1 μm |
| 2 | 1 kg/cm | 1450° C. | 1 h | 0.5 μm | 5 μm |
| 3 | 9.8 kg/cm | 1500° C. | 1 h | 0.8 μm | 1 μm |
| 4 | 5 kg/cm | 1420° C. | 1 h | 0.5 μm | 1 μm |
| 5 | 5 kg/cm | 1500° C. | 1 h | 1 μm | 10 μm |
| 6 | 5 kg/cm | 1420° C. | 1 h | 0.5 μm | 20 μm |
| 7 | 5 kg/cm | 1420° C. | 1 h | 0.5 μm | 5 μm |
| 8 | 5 kg/cm | 1500° C. | 1 h | 1 μm | 5 μm |
| 9 | 5 kg/cm | 1420° C. | 1 h | 0.6 μm | 5 μm |
| 10 | 5 kg/cm | 1420° C. | 1 h | 0.6 μm | 5 μm |
| 11 | 5 kg/cm | 1500° C. | 1 h | 1 μm | 5 μm |

The sintered products had a deposited particle diameter d (see FIG. 2C) of 0.2 to 1 micron and a layer thickness h (see FIG. 2C) of 1 to 20 microns.

(7) Durability Tests

The throwaway tips made as Samples 1 to 11 were tested for cutting steel under the following conditions:

material to be cut: A round bar of JIS SNCM439 (nickel-chromium-molybdenum) steel;

Steel hardness: HB (Brinell hardness) 240;

Cutting speed: 200 m/min.;

Feed rate: 0.5 mm/revolution;

Cutting time: 30 min.

The results are shown in Table 3, in which "Poor" means that the sample became incapable of cutting in less than 30 minutes, "Fair" means that the sample remained capable of cutting for 30 minutes, though it was damaged, and "Good" means that the sample was not damaged, but was fully capable of cutting for over 30 minutes.

TABLE 3

| Sample | Thickness of a layer of deposited particles | Durability |
|---|---|---|
| 1 | 1 μm | Poor |
| 2 | 5 μm | Fair |
| 3 | 1 μm | Poor |
| 4 | 1 μm | Poor |
| 5 | 10 μm | Good |
| 6 | 20 μm | Good |
| 7 | 5 μm | Good |
| 8 | 5 μm | Good |
| 9 | 5 μm | Good |
| 10 | 5 μm | Good |
| 11 | 5 μm | Good |

Samples 1, 3 and 4 were poor in durability, Sample 2 was fair and Samples 5 to 11 were good. These results teach that the durability of each sample depends on the (effective) thickness h of its layer of deposited particles, and that good durability calls for a thickness h of at least 5 microns.

In addition to the above experiments, examination was also made to determine if and how the deposited particles would be affected by the number of times of dipping, the concentration of the alkoxide, the use of a single, or mixed alkoxide and the sintering temperature. The results are shown in graphs. The data shown by the graphs do not necessarily coincide with what is shown in Table 1 or 2.

Figure 3:
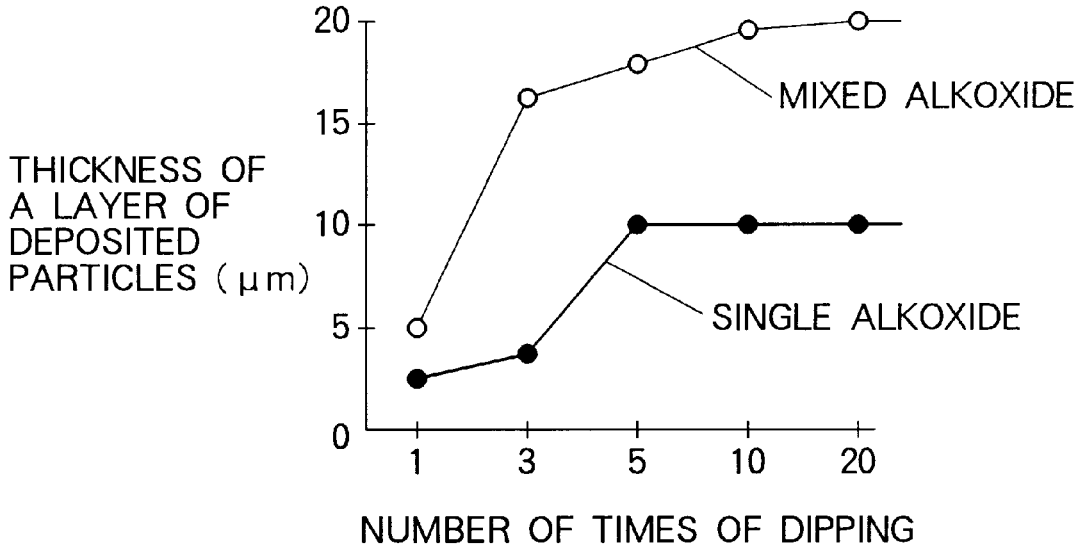
FIG. 3 is a graph showing the relation as found between the number of times of dipping repeated and the thickness of a layer of particles thereby deposited.

FIG. 3 is a graph showing the relation as found between the number of times of dipping as shown along the x-axis and the thickness h of a layer of deposited particles as shown along the y-axis. The thickness h is defined in FIG. 2C. While the thickness h showed an increase substantially in proportion to the number of times of dipping, its increase was small after five times of dipping in a single alkoxide, and after three times of dipping in a mixed alkoxide. These results teach that dipping is preferably repeated between, say, two and four times.

Figure 4:
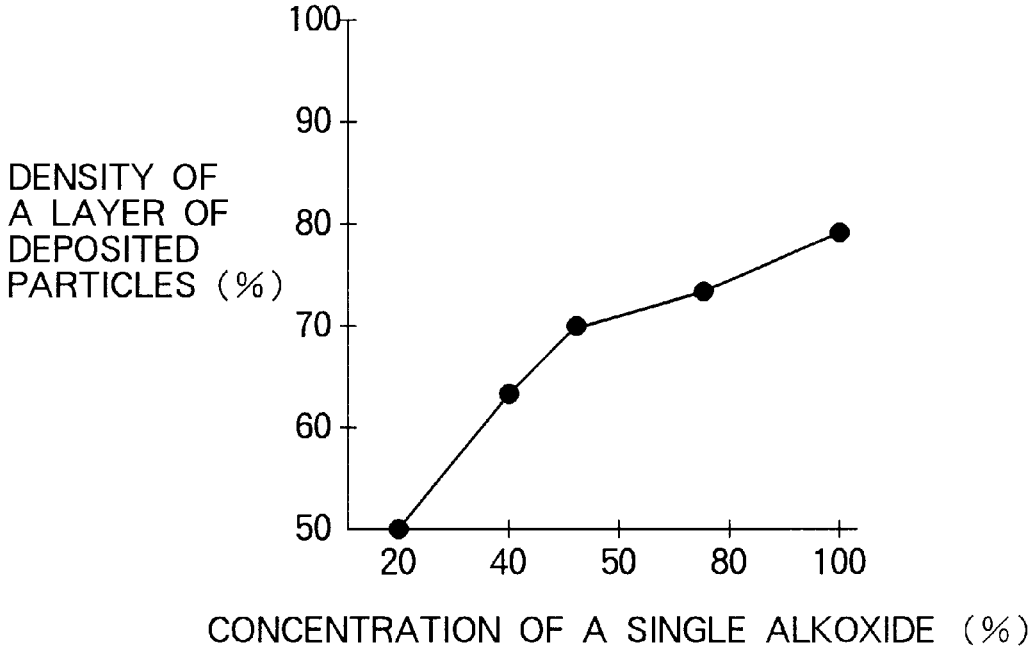
FIG. 4 is a graph showing the relation as found between the concentration of an alkoxide employed and the density of a layer of particles thereby deposited.

FIG. 4 is a graph showing the relation as found between the concentration of a single alkoxide as shown in % by volume along the x-axis and the density Q of a layer of deposited particles as shown along they-axis, and as will be defined below. The magnification of the surface of the sintered product reveals the particles deposited on the base metal. It is more desirable for a greater number of particles to be deposited and occupy a larger area. The density of a layer of deposited particles is defined as:

Density Q=Total area occupied by deposited particles in unit area S (see FIG. 2C)/Unit area S×100

The density Q was found to increase in proportion to the concentration of the single alkoxide.

Figure 5:
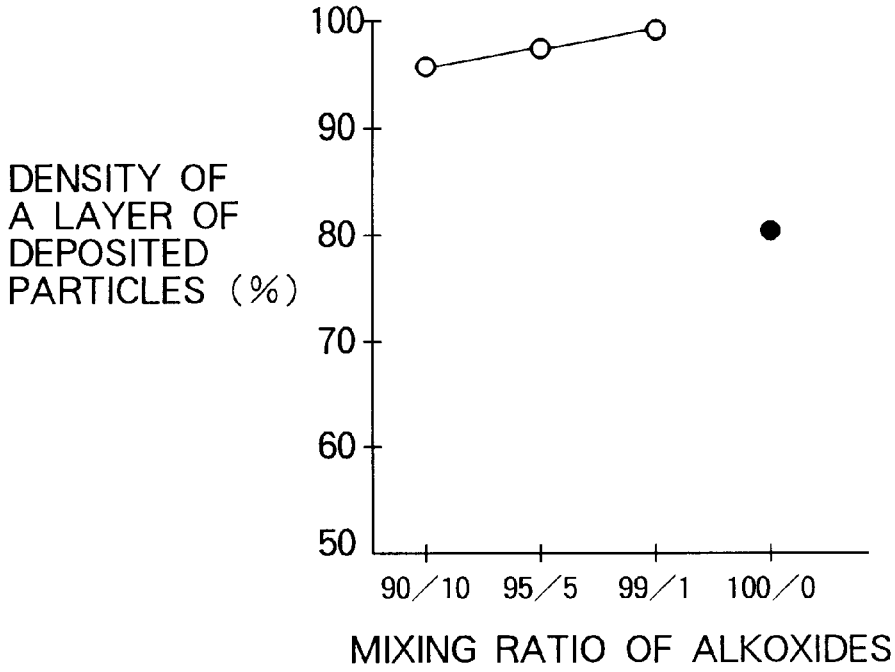
FIG. 5 is a graph showing the relation as found between the mixing ratio of alkoxides employed and the density of a layer of particles thereby deposited.

FIG. 5 is a graph showing the relation as found between the mixing ratio of alkoxides and the density Q. The ratio of alkoxides as shown along the x-axis is the ratio of a single alkoxide to another alkoxide. The ratio of 100/0 as shown at the right end of the x-axis means that a single alkoxide was employed, and a density Q of 80% was obtained on that occasion. The ratios of 90/10, 95/5 and 99/1 mean that mixed alkoxides were employed, and on those occasions, there was obtained a density Q of 95% or higher indicating that substantially the whole surface of the base metal was covered with deposited particles.

Figure 6:
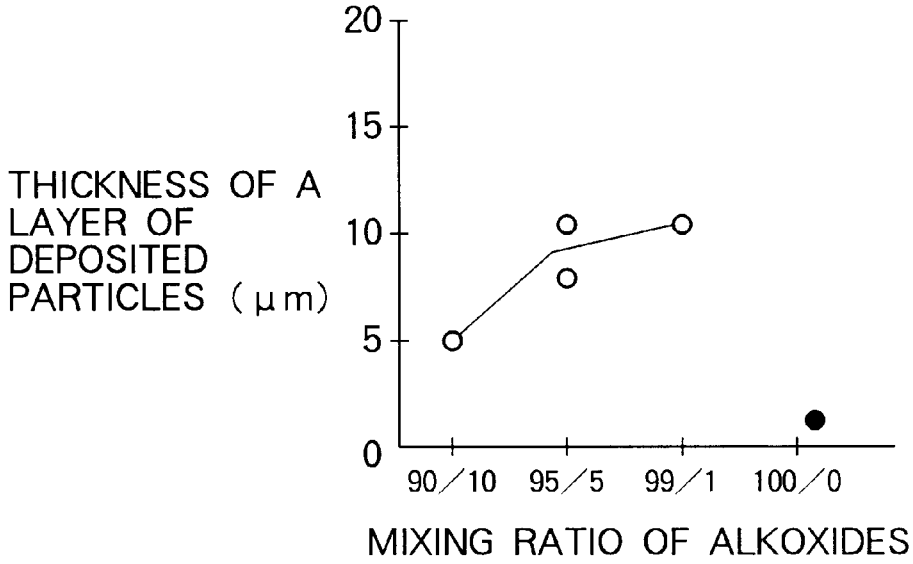
FIG. 6 is a graph showing the relation as found between the mixing ratio of alkoxides employed and the thickness of a layer of particles thereby deposited.

FIG. 6 is a graph showing the relation as found between the mixing ratio of alkoxides as shown along the x-axis and the thickness of a layer of deposited particles as shown along the y-axis, and as shown at h in FIG. 2C. The layers formed by employing mixed alkoxides having a mixing ratio of 90/10, 95/5 or 99/1 had a thickness h which was greater than that of the layer formed by employing a single alkoxide as shown at 100/0.

Figure 7:
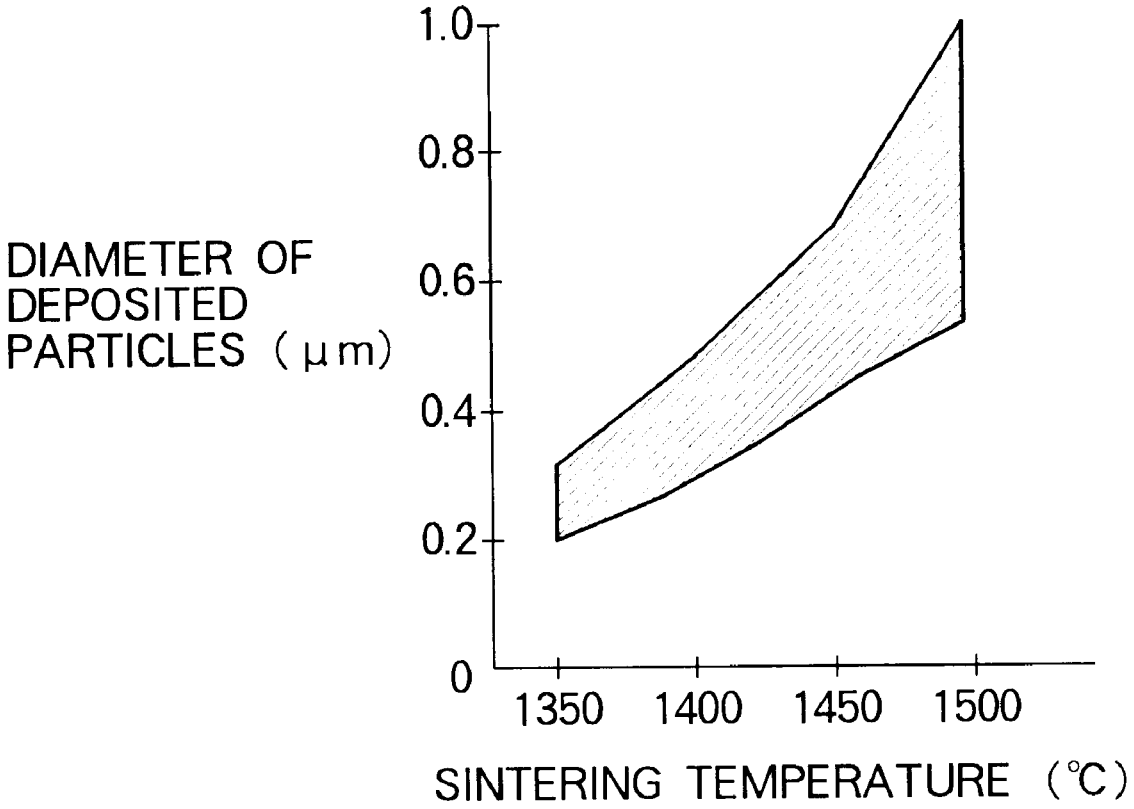
FIG. 7 is a graph showing the relation as found between the sintering temperature employed and the diameter of particles thereby deposited.

FIG. 7 is a graph showing the relation as found between the sintering temperature as shown along the x-axis and the diameter d of deposited particles (see FIG. 2C) as shown along they-axis. As is obvious from the graph, the diameter d showed an increase in proportion to the sintering temperature.

These graphs make it possible to select the number of times for repeating dipping, the concentration of an alkoxide, a single or mixed alkoxide and the sintering temperature which are most adequate for making any product demanded.

The process of this invention is useful for modifying the surface of a cutting tool, such as a throwaway tip, bite, drill, or milling cutter, while it is also applicable for the modification of the surface of a mold having a base metal formed from a hard material.

Obviously, various minor changes and modifications are possible in the light of the above teaching. It is to be understood that within the scope of the appended claims the present invention may be practiced otherwise than as specifically described.

What is claimed is:

1. A cutting tool prepared by a process comprising the steps of:

compacting a powder of a hard material consisting mainly of tungsten carbide to create a compacted product;

baking the compacted product of said powder to create a backed product;

dipping the baked product in an alkoxide containing titanium; and sintering the alkoxide-dipped baked product in a nitrogen gas atmosphere, whereby titanium carbide, nitride or carbide-nitride particles having a diameter of 0.5 to 1.0 micron are deposited in a layer having a thickness of at least 5 microns on the surface of the hard material.

* * * * *